US005702178A

United States Patent [19]

Smith et al.

[11] Patent Number: 5,702,178

[45] Date of Patent: Dec. 30, 1997

[54] LAMP ASSEMBLY COMPRISING A VENTILATION PASSAGE

[75] Inventors: Alan Keith Smith, Staffordshire; John Frederick Monk, Birmingham; Robert Frank Tolley, Staffordshire, all of Great Britain

[73] Assignee: Magneti Marelli UK Limited, Cannock, United Kingdom

[21] Appl. No.: 583,112

[22] PCT Filed: Jul. 8, 1994

[86] PCT No.: PCT/GB94/01483

§ 371 Date: Apr. 8, 1996

§ 102(e) Date: Apr. 8, 1996

[87] PCT Pub. No.: WO95/02783

PCT Pub. Date: Jan. 26, 1995

[30] Foreign Application Priority Data

Jul. 13, 1993 [GB] United Kingdom ..... 9314465

[51] Int. Cl.[6] ..... F21V 29/00

[52] U.S. Cl. ..... 362/294; 362/373

[58] Field of Search ..... 362/61, 294, 345, 362/376, 373

[56] References Cited

U.S. PATENT DOCUMENTS

| | | | |
|---|---|---|---|
| 4,405,974 | 9/1983 | Quiogue | 362/294 |
| 5,010,453 | 4/1991 | Ketteraman | 362/61 |
| 5,367,438 | 11/1994 | Deslandres | 362/294 |
| 5,388,037 | 2/1995 | Umeda et al. | 362/294 |
| 5,562,337 | 10/1996 | Takinami et al. | 362/294 |

FOREIGN PATENT DOCUMENTS

| | | |
|---|---|---|
| 2626060 | 7/1989 | France . |
| 2658136 | 8/1991 | France . |
| 2237626 | 10/1990 | United Kingdom . |

*Primary Examiner*—Stephen F. Husar
*Assistant Examiner*—Sara Sachie Raab
*Attorney, Agent, or Firm*—Jacobson, Price, Holman & Stern, PLLC

[57] ABSTRACT

A motor vehicle headlamp has a dished housing (10) in which a light source is located and which is closed at its front by a light transmitting cover. A ventilation passage (16, 26, 30) provides communication between the interior and exterior of the housing. The ventilation passage is defined by a tubular portion (12) extending from the housing (10) and by a cap (20) mounted on the tubular portion (12) so that an end wall (28) of the cap (20) is spaced outwardly from a housing-remote end of the tubular portion (12). The tubular portion (12) has a continuous side wall. The end wall (28) is joined to mutually spaced lateral walls (24) of the cap (20) whereby there is defined a downwardly opening slot (26) forming part of the ventilation passage (16, 26, 30). The end wall (28) of the cap (20) projects downwardly beyond lower edges of the lateral walls (24) of the cap (20).

10 Claims, 2 Drawing Sheets

LAMP ASSEMBLY COMPRISING A VENTILATION PASSAGE

BACKGROUND OF THE INVENTION

1. Field of the Invention

This invention relates to a lamp assembly and is particularly, but not exclusively, concerned with a motor vehicle headlamp.

2. Description of the Related Art

It is now common practice to provide vehicle lamp assemblies with a ventilation passage which provides communication between the interior of a housing of the lamp assembly and the exterior. Such a ventilation passage is designed to reduce condensation within the housing and to limit ingress of water. A vehicle headlamp assembly having a ventilation passage is disclosed in GB-A-2237626 where a housing contains a reflector and a light source. The interior of the housing communicates with the exterior via a ventilation passage which is of labyrinth form and which is defined by a tubular appendix extending outwardly from the housing and by a cup-shaped cap fitted to the free end of the appendix. The tubular appendix is split longitudinally by a transverse dividing wall so as to define two separate chambers. The tubular appendix has a slot in its side wall opening into one of the chambers, whilst the other chamber opens into the interior of the housing. The cup-shaped cap partly closes the longitudinal opening. However, under tests which are intended to replicate severe operating conditions in practice, a water spray is directed at the lamp assembly through large angles of arc. And at the same time the lamp assembly is switched on and off, thereby creating a pressure differential between the interior and the exterior of the housing. Results indicate that water can collect in the outer chamber of the labyrinth to such an extent that the water can be sucked into the housing when the internal pressure reduces at the time when the lamp is switched off.

SUMMARY OF THE INVENTION

It is an object of the present invention to obviate or mitigate this disadvantage.

According to the present invention, there is provided a lamp assembly comprising a housing in which a light source is located in use and having a light transmitting cover, and a ventilation passage providing communication between the interior and the exterior of the housing, said ventilation passage being defined by a tubular portion extending from the housing and by a cap mounted on the tubular portion, wherein the tubular portion has a continuous side wall and the cap is mounted on the tubular portion so that an end wall of the cap is spaced outwardly of a housing-remote end of the tubular portion and is joined to mutually spaced lateral walls of the cap whereby there is defined a downwardly opening slot forming part of the ventilation passage, and wherein the end wall of the cap projects downwardly beyond lower edges of the lateral walls of the cap.

Most preferably, a lower edge region of the end wall of the cap is chamfered on at least one surface thereof.

Preferably, the chamfering is on the external surface of the end wall, i.e, the surface opposite to that which lies within the ventilation passage.

The degree of chamfer is preferably such that the thickness of the end wall of the cap at the lower edge thereof is less than or equal to 50% of the thickness of the remainder of the end wall.

Preferably, the lateral walls of the cap extend forwardly from the end wall of the cap so as to overtap the side wall of the tubular portion.

More preferably, the lateral walls extend over the entire length of the cap.

Conveniently, the housing-remote end of the peripheral wall of the tubular portion is also externally chamfered.

Most conveniently, the internal surface of the end wall of the cap is planar.

In order to reduce further the risk of spray water entering the housing, the lamp assembly may also include a shield which is fixed relative to the tubular portion and the cap so that a lower surface of the shield is disposed in spaced relationship below the lower opening of the slot and projects rearwardly beyond the end wall of the cap.

The terms "downwardly" and "rearwardly" as used herein refer to the arrangement when the lamp assembly is in an orientation corresponding to that in which it is intended to be used.

BRIEF DESCRIPTION OF THE DRAWINGS

Embodiments of the present invention will now be described, by way of example, with reference to the accompanying drawings, in which.

DETAILED DESCRIPTION OF THE PREFERRED EMBODIMENTS

Figure 1:
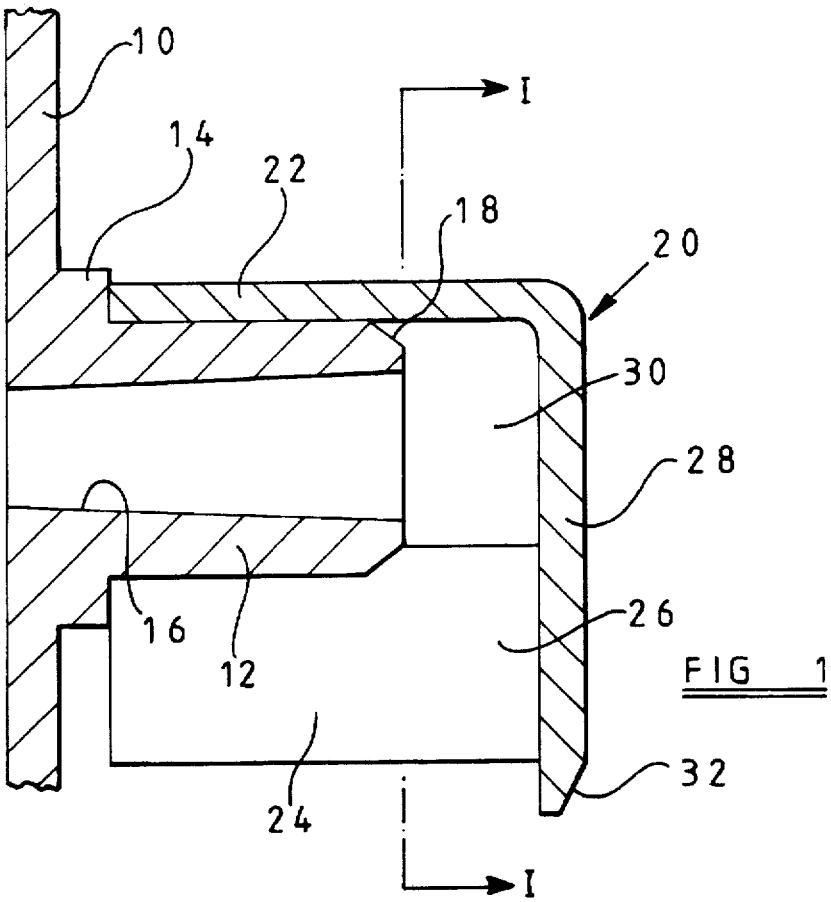
FIG. 1 is an axial section through part of a vehicle headlamp assembly in the region of the ventilation passage.
Figure 2:
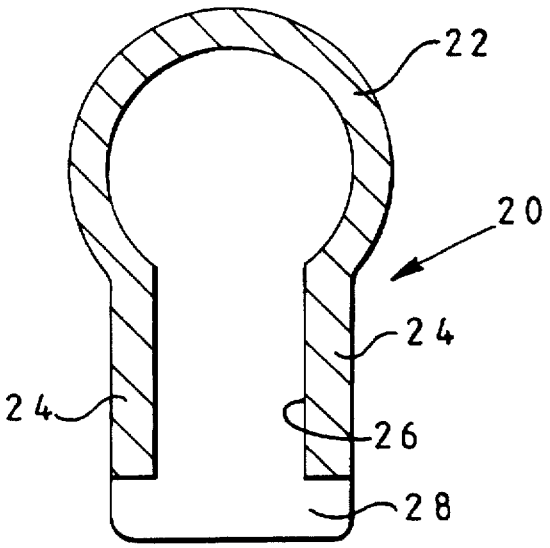
FIG. 2 is a section on the line I—I of FIG. 1.

Referring now to FIGS. 1 and 2 of the drawings, the vehicle headlamp assembly comprises a dished housing 10 having a front opening (not shown) closed by a light-transmitting front cover (also not shown) and containing a reflector and a lamp providing a light source. Vehicle headlamp assemblies of this type are very well known and their construction is well understood by those skilled in the art. The housing 10 is moulded out of a synthetic resin material with an integrally formed, rearwardly-extending tubular portion 12 towards the top of the housing 10.

The tubular portion 12 is of circular cross-section with a step 14 provided at its junction with the remainder of the housing 10. The tubular portion 12 has a longitudinally-undivided central passage 16 therethrough which is of circular cross section and which has a slight draw-angle to enable die tool removal during moulding. The outer end (i.e., the right hand end as viewed in FIG. 1) of the passage 16 has a diameter of at least 4 mm (in this embodiment 5 mm, although it may be greater than this). The peripheral wall of the tubular portion 12 over its outer end region 18 is chamfered at an angle of about 30° relative to the longitudinal axis of the tubular portion 12. The passage 16 defines part of a ventilation passage serving to provide communication between the exterior and the interior of the housing 10.

The lamp assembly further comprises a moulded synthetic resin end cap indicated generally by arrow 20. The end cap 20 has a part-cylindrical wall 22 which is a push fit over the tubular portion 12. The free end of the part-cylindrical wall 22 abuts against step 14. The cap 20 further includes a pair of lateral walls 24 which extend laterally to the wall 22 and the tubular portion 12 and which are spaced apart so as to define a slot 26 therebetween. The end cap 20 further includes an end wall 28 which is integrally formed with the walls 22 and 24 so as to close the outer side of the slot 26 between the walls 24. The inner end of the slot 26 (i.e, that end which faces the housing 10) is open. As can be seen from FIG. 1, the length of the wall 22 as compared with that of the tubular portion 12 is such that the end wall 28 is spaced from the outer end of the tubular portion 12 whereby to define a chamber 30. The slot 26, chamber 30 and passage 16 together form the ventilation passage.

As will be appreciated from FIGS. 1 and 2, the slot 26 is open to atmosphere at its lower end and at its housing-adjacent side. The length of each wall 24 in the axial direction of the tubular portion 12 is such that each wall 24 overlaps the tubular portion 12 for a substantial region thereof, in this embodiment virtually the total length of the tubular portion 12 projecting from the step 14. The walls 24 extend downwardly below the tubular portion 12 for a distance of more than 5 mm, i.e., a distance which exceeds the maximum diameter of the passage 16 and which also exceeds the width (4.5 mm, although it may be larger) of the chamber 30, i.e, that dimension of the chamber 30 which extends axially of the tubular portion 12. The dimension of each wall 24 in the axial direction of the passage 16 is about 20 mm, i.e., over three times the width of the chamber 30, although this is not an essential requirement.

The end wall 28 has a substantially planar inner face and extends downwardly so as to project beyond the lower edges of the walls The external surface of the end wall 28 is chamfered over the lower end region 32 thereof which projects below the lateral walls 24. The degree of chamfer, in this embodiment, is about 30° and the chamfering is arranged such that the thickness of the lower edge of the end wall 28 is about 30% of the total thickness of the end wall 28. Because of the projection of the end wall 28 below the lateral walls 24 and because of the provision of the chamfer thereon, it is found that when the headlamp assembly is subjected to a water-spray test directed at the assembly through large angles of arc and at the same time energizing the bulb in an on and off switching cycle, any spray water which collects on the end cap 20 tends to flow downwardly so as to drip off the chamfered lower edge in a manner in which it is not sucked into the housing 10.

Figure 3:
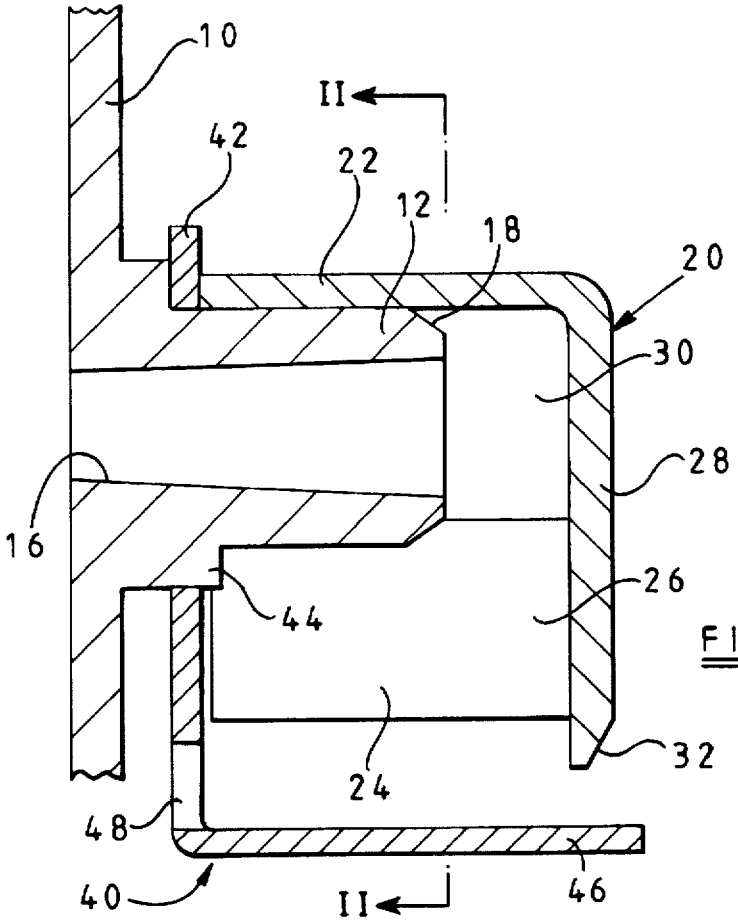
FIG. 3 is a section similar to FIG. 1 of another embodiment of vehicle headlamp assembly.
Figure 4:
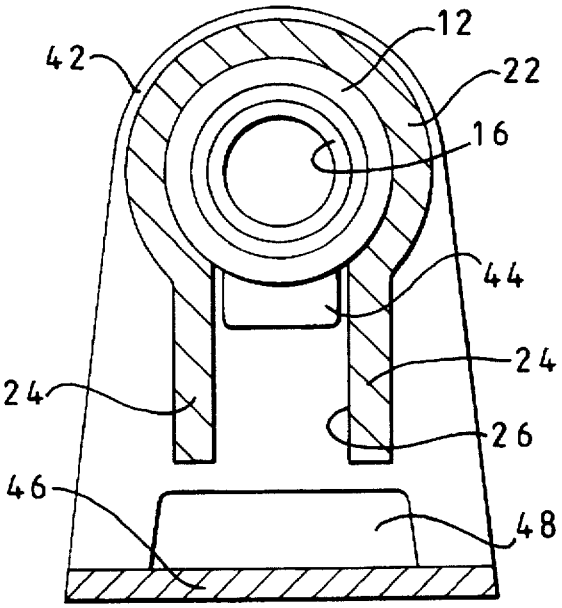
FIG. 4 is a section on the line II—II of FIG. 3.

Referring now to FIGS. 3 and 4, the headlamp assembly illustrated therein is similar to that of FIGS. 1 and 2 and similar parts are accorded the same reference numerals. However, in this embodiment, the headlamp assembly further includes a shield 40 which is of L-shaped form. One arm 42 of the shield 40 is apertured and fitted onto the tubular portion 12 so as to rest against the step 14 and is held thereon by means of the part-cylindrical wall 22 of the end cap 20. In this embodiment, the tubular portion 12 is formed with a lug 44 thereon to ensure that the cap 20 can only be fitted in the correct orientation with the lateral walls 24 and slot 26 facing downwardly. The other arm 46 of the shield 40 is horizontally disposed under and spaced from the walls 24 and 28 of the cap 20. The spacing between the lower end of the end wall 28 and the arm 46 is at least 3 mm and is preferably about 5 mm. A drain hole 48 is provided at the lower end of the arm 42 to prevent water from collecting on the upper surface of arm 46. The arm 46 projects outwardly away from the housing 10 beyond the end wall 28 so as to provide complete protection against unwanted spraying of water upwardly directly into the slot 26.

In the above embodiment, the shield 40 is a separately produced item. However, in another embodiment, the shield 40 with aperture 48 is integrally moulded with the dished housing 10 of the vehicle headlamp. For example, the dished housing 10 may be moulded with a rearwardly facing recess therein in which at least the lower regions of the lateral walls of the end cap 20 are received, such recess having side walls and a base wall. The base wall is the equivalent of the arm 46 and is most preferably inclined sufficiently downwardly and rearwardly to prevent water from collecting thereon in use and being drawn into the housing 10. The terms "lower", "horizontally", "upwardly", "forwardly" and "downwardly" relate to the arrangement of the items referred to when the headlamp assembly is in the orientation in which it is intended to be used on a motor vehicle.

We claim:

1. A lamp assembly comprising a housing for a light source having a light transmitting cover, and means defining a ventilating passage providing communication between an interior and an exterior of said housing, said means defining a ventilation passage comprising (i) a tubular portion which extends from said housing and which has a continuous side wall with a top end, and (ii) a cap which is mounted on said tubular portion and which has an end wall and spaced lateral walls, each lateral wall having a lower edge; wherein said cap is mounted on said tubular portion so that said end wall of said cap is spaced outward and apart from said top end of said tubular portion and is joined with said lateral walls of said cap so as to define a downwardly opening slot and wherein said end wall of said cap projects downwardly beyond said lower edges of said lateral walls of said cap and has a lower edge region which is chamfered on at least one surface of said end wall.

2. The lamp assembly according to claim 1, wherein said at least one surface is external to the ventilation passage.

3. The lamp assembly according to claim 1, wherein said lower edge region is chamfered to a degree such that the thickness of said end wall of said cap at said lower edge thereof is less than or equal to 50% of the thickness of the remainder of said end wall.

4. The lamp assembly according to claim 1, wherein said lateral walls of said cap extend forwardly from said end wall of said cap so as to overlap said continuous side wall of said tubular portion.

5. The lamp assembly according to claim 4, wherein said lateral walls of said cap extend from said end wall of said cap to an opposite end of said cap.

6. The lamp assembly according to claim 1, wherein said top end is externally chamfered.

7. The lamp assembly according to claim 1, wherein said end wall of said cap has an internal surface which is planar.

8. The lamp assembly according to claim 1, wherein said top end has a diameter of at least 4 mm.

9. The lamp assembly according to claim 1, further including a shield which is fixed relative to said tubular portion and said cap so that a lower surface of said shield is disposed in spaced relationship below a lower opening of said slot and projects rearwardly beyond said end wall of said cap.

10. The lamp assembly according to claim 9, wherein said shield and said lower edge of said end wall are spaced apart by a distance of at least 3 mm.

* * * * *